US005852838A

United States Patent [19]

Johnson

[11] Patent Number: 5,852,838

[45] Date of Patent: Dec. 29, 1998

[54] CUSHION AND METHOD FOR PROVIDING A SUBSTANTIALLY FLAT DIAPER-CHANGING SURFACE FOR VEHICLE SEATS

[76] Inventor: Christopher W. Johnson, Rte. 5, Box 296M, Ft. Payne, Ala. 35967

[21] Appl. No.: 928,843

[22] Filed: Sep. 12, 1997

Related U.S. Application Data

[60] Provisional application No. 60/025,308 Sep. 24, 1996.

[51] Int. Cl.[6] ..... A47D 5/00; A47D 7/00

[52] U.S. Cl. ..... 5/655; 5/94; 5/118

[58] Field of Search ..... 5/655, 94, 632, 5/652, 118, 603

[56] References Cited

U.S. PATENT DOCUMENTS

| | | | |
|---|---|---|---|
| D. 343,756 | 2/1994 | Sher | 5/655 |
| 2,555,659 | 6/1951 | Rose | 5/94 |
| 2,676,337 | 4/1954 | Soeder | 5/94 |
| 4,583,253 | 4/1986 | Hall | 5/655 |
| 5,310,245 | 5/1994 | Lyszczasz | 5/655 |
| 5,367,730 | 11/1994 | Sher | 5/655 |
| 5,524,640 | 6/1996 | Lisak et al. | 5/655 |

FOREIGN PATENT DOCUMENTS

| | | | |
|---|---|---|---|
| 2635667 | 3/1990 | France | 5/94 |

*Primary Examiner*—Alex Grosz

*Attorney, Agent, or Firm*—Lanier Ford Shaver & Payne P.C.; Frank M. Caprio, Esq.; Russell L. Sandidge, Esq.

[57] ABSTRACT

The instant invention provides a cushion for use with sloped vehicle seats, to provide a substantially level and horizontal surface upon which to change infant's diapers. The cushion features a top surface and a bottom surface, with the bottom surface being angled slightly relative to the top surface. The cushion has a generally triangular cross section, featuring a relatively thin front edge, and a relatively thick rear edge. The angle between the top and bottom surfaces roughly matches the slope of the vehicle seat, so that when the cushion is placed on a sloped seat with the thick edge toward the rear and with the thin edge toward the front, the top surface is substantially level and horizontal. The cushion can be provided with one or more torso supports on the top surface to further stabilize the infant. The bottom surface of the cushion can be provided with one or more cut-outs to lighten the cushion and allow it to conform to the seat surface. The cushion is preferably formed from polyethylene foam, with a finished skin-type surface that allows for easy cleaning.

6 Claims, 2 Drawing Sheets

CUSHION AND METHOD FOR PROVIDING A SUBSTANTIALLY FLAT DIAPER-CHANGING SURFACE FOR VEHICLE SEATS

This application claims the benefit of U.S. Provisional Application Serial No. 60/025,308, filed 24 Sep. 1996, entitled "BACKSEAT BABY DIAPER CHANGING PAD."

BACKGROUND

For as long as parents have traveled with infant children, parents have had to change diapers while en route to their destinations. Whether parents are traveling in automobiles, buses, airplanes, or trains, changing their children's diapers imposes substantial inconvenience, chiefly because there are often no horizontal surfaces immediately nearby that are suitable for supporting the baby.

Parents must often change their children upon the same seats used by the parents. Typically, these seats are angled or sloped to promote the comfort of a seated adult, with the front edge of the seat being raised relative to the rear edge of the seat. Such an arrangement is comfortable for a seated adult, but if a parent tries to change an infant on such a seat by laying the infant lengthwise across the seat, the infant may tend to roll or slip down the seat until he meets the seat back. At that point, the infant will likely be less accessible to the increasingly frustrated parent. Not only must the parent deal with a squirming infant, but also with an infant who is sliding or rolling down the sloped seat surface, all the while in very tight quarters.

Accordingly, a need exists for a device that allows parents to readily convert any typical sloped seat surface into a substantially horizontal and level surface. Such a device would be especially useful in the close-quarters circumstances often encountered during travel. Then, the parent can place the infant on this horizontal surface and change the diaper, without fear that the infant will slide or roll into danger or become less accessible. Such a device should be lightweight, portable, and easily storable to facilitate its packing and use while traveling. Finally, such a device should have a stain-resistant surface that can be cleaned easily.

SUMMARY

The above need in the art motivated the instant invention. A first objective of this invention is to provide a diaper changing pad that readily converts any typical sloped vehicle seat surface into a substantially horizontal and level surface suitable for supporting the infant during diaper changing.

A second objective is to provide a diaper changing pad that is generally triangular in cross-section, with the thickness of the pad varying from relatively thin at a front edge to relatively thick at an opposite rear edge, so that the pad can be placed on a typical sloped vehicle seat surface, with the thick edge toward the rear of the seat and the thin edge toward the front of the seat, thus presenting a substantially horizontal and level changing surface when the pad is placed properly on the seat.

A third objective is to provide a diaper changing pad that includes a top surface and a bottom surface being angled relative to the top surface, so that the angle between the top surface and the bottom surface complements the angle of the seat surface, resulting in the top surface being substantially horizontal and level.

A fourth objective is to provide a diaper changing pad with at least one torso support to further restrain the infant from rolling or sliding on the pad.

A fifth objective is to provide a diaper changing pad that is resilient, lightweight, portable, compact, and thus easily storable.

A sixth objective is to provide a method of using the diaper changing pad to readily convert any typical sloped vehicle seat into a substantially horizontal surface suitable for diaper changing.

DETAILED DESCRIPTION OF THE PREFERRED EMBODIMENT

The invention will now be described in detail with reference to the attached drawings.

Figure 1:
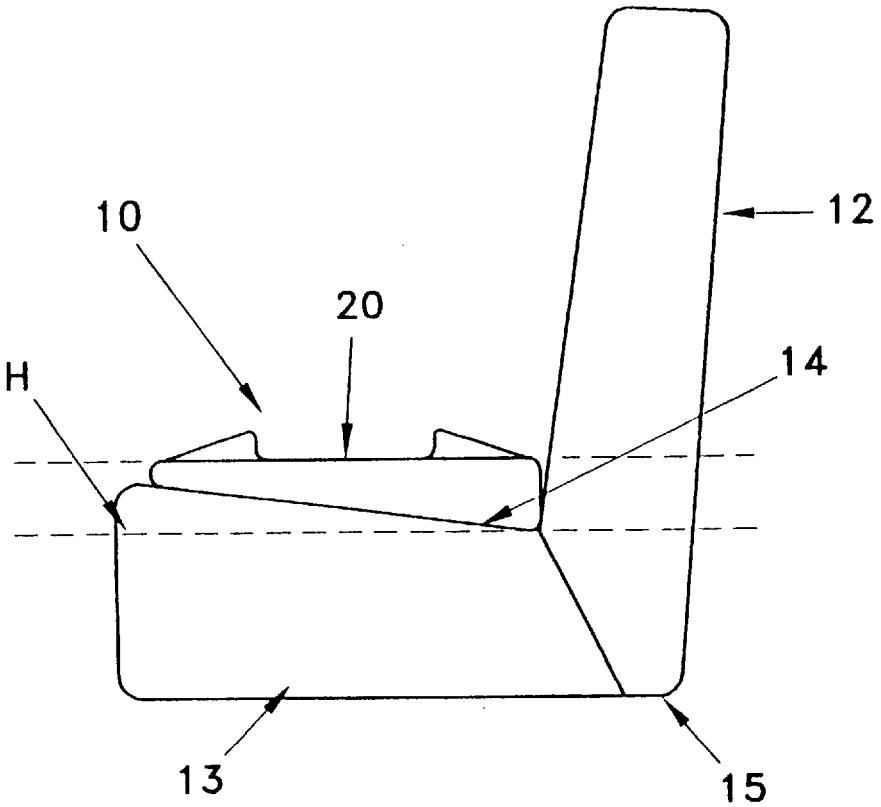
FIG. 1 is a side elevational view of the diaper changing pad placed in a typical vehicle seat.

FIG. 1 is a side elevational view of diaper changing cushion 10 placed upon conventional vehicle seat 15 having lower portion 13 and seat back 12. Lower portion 13 includes a sloped surface 14, which is typically angled to provide a seat with good comfort and ergonomic characteristics. Sloped surface 14 is typically angled slightly relative to horizontal reference line H, shown in dashed outline. If an infant (not shown) is placed with the height of his body parallel to the length of seat 15, the infant may roll or slide toward seat back 12 because of the downward angle of sloped surface 14. Also, if an infant is placed with his body perpendicular to the length of seat 15, the infant may be inaccessible to the parent because of an adjacent seat (not shown) or other nearby interfering structure.

Cushion 10 solves the above problem by providing a substantially level, horizontal top surface 20 upon which the infant may be laid lengthwise, and held relatively stationary. Thus, the infant is unlikely to roll or slide toward seat back 12, and will remain accessible to a parent reaching from beside seat 15. This function is especially helpful when a parent is changing an infant's diaper in the back seat of a vehicle by standing outside the vehicle and reaching over the side of the seat, or by sitting next to the infant on the seat and reaching sideways toward the infant.

In the context of this application, "substantially level and horizontal" means sufficiently level and horizontal so that the infant does not roll or slide toward seat back 12. Substantially level and horizontal does riot necessarily mean absolutely level or horizontal. Also, the term "infant" is not intended to limit the use of cushion 10; cushion 10 can be used with any child wearing diapers.

Seat 15 as shown is a typical vehicle seat. It should be understood that seat 15 can be a bench-style seat or a bucket seat. Also, seat 15 should be understood to be any vehicle seat having a sloped surface 14, whether that vehicle is an automobile, train, airplane, or bus. Cushion 10 is intended to be useful with any seat 15 having a sloped surface 14.

Figure 2:
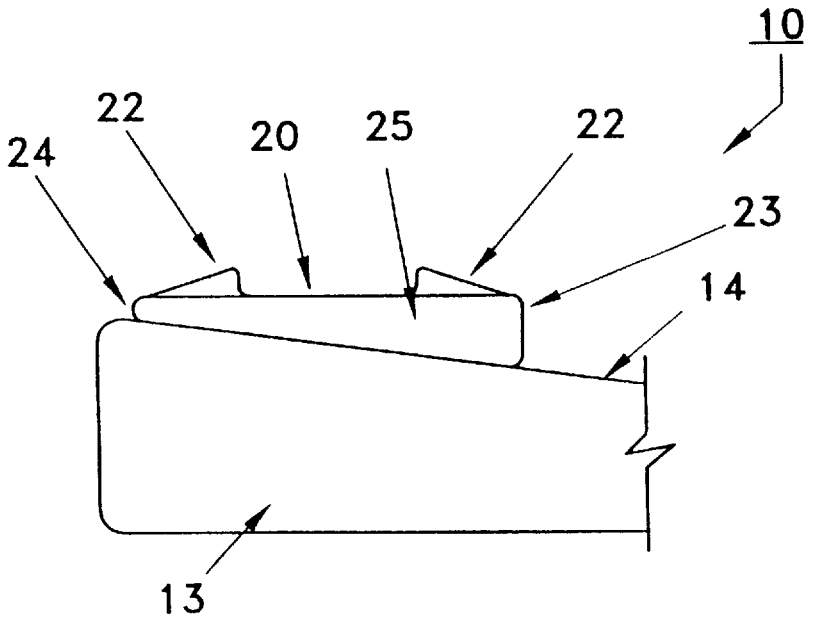
FIG. 2 is a side elevational view of the pad.

FIG. 2 is a side elevational view of cushion 10, with a fragmented view of lower portion 13. Cushion 10 includes pad 25, which has top surface 20 and bottom surface 21. Top surface 20 and bottom surface 21 are angled relative to one another. As seen in FIG. 2, this angle is a very slight, acute angle that roughly corresponds to the angle between sloped surface 14 and the horizontal. This arrangement results in top surface 20 being approximately level and horizontal when cushion 10 is placed on lower portion 13. Cushion 10 presents a generally triangular cross-section when viewed along its length.

It should be understood that the angle between top surface 20 and bottom surface 21 can be varied, depending on the angle of sloped surface 14 on a given seat 15, to ensure that top surface 20 is approximately level and horizontal when cushion 10 is placed properly on sloped surface 14. Thus, cushion 10 can be tailored to fit specific configurations of seat 15. Also, bottom surface can be contoured slightly to match any irregularities present in sloped surface 14, so that cushion 10 provides a stable platform for diaper changing.

As shown in FIG. 2, cushion 10 includes front edge 24 and rear edge 23. Front edge 24 is aligned with the front of lower portion 13, while rear edge 23 is aligned with the rear of lower portion 13, closer to seat back 12. Cushion 10 is thicker at rear edge 23 than at front edge 24, resulting in the substantially level and horizontal orientation of top surface 20 when cushion 10 is placed properly on lower portion 13.

Cushion 10 includes one or more torso supports 22 attached to top surface 20. Although FIG. 2 illustrates two torso supports 22, one torso support 22 may be suitable in certain applications. An infant (not shown in FIG. 2) may be placed proximate one torso support 22, or may be placed between two torso supports 22. The purpose of torso supports 22 is to prevent the infant from sliding or rolling on top surface 20. The substantially level and horizontal orientation of surface 20 will largely prevent the infant from passively rolling or sliding due to his weight, but torso supports 22 help to prevent the infant from actively rolling or sliding due to kicking or squirming.

Figure 3:
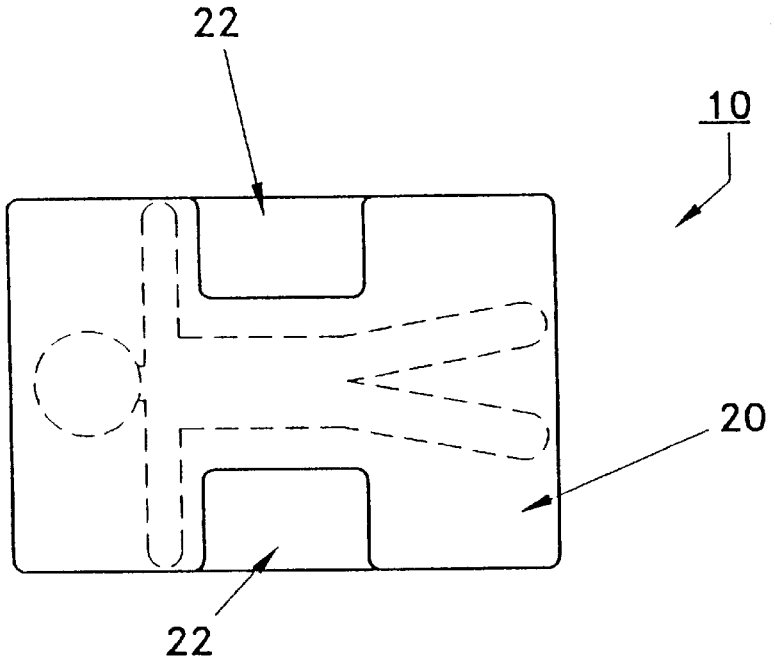
FIG. 3 is a top plan view of the pad.

FIG. 3 is a top plan view of cushion 10, featuring the placement of torso supports 22, with and infant shown schematically therebetween in dashed outline. Cushion 10 can be sized to fit any seat, but preferable dimensions include a length of approximately 2 feet, and a width of approximately 1.5 feet.

Figure 4:
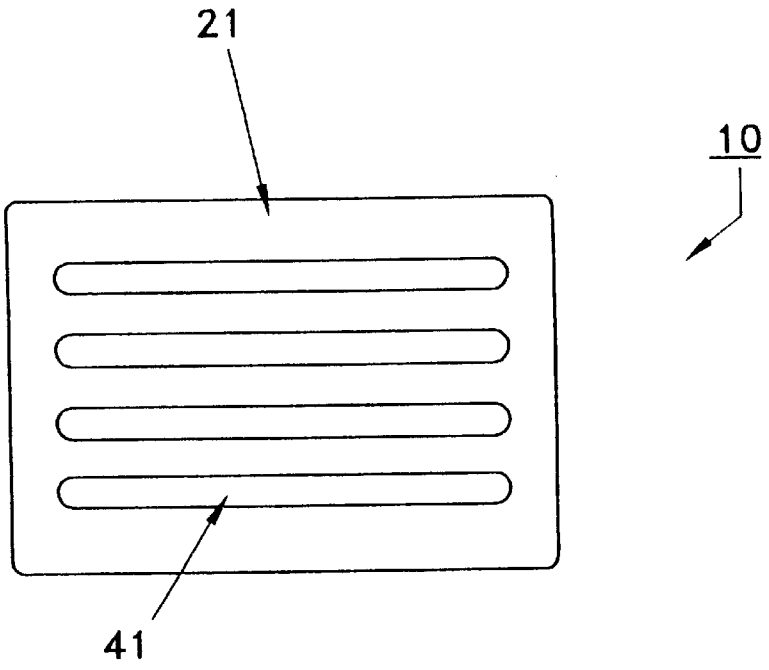
FIG. 4 is a bottom plan view of the pad.

FIG. 4 is a bottom plan view of cushion 10, illustrating the plurality of cut-outs 41 located beneath cushion 10. Cut-outs 41 reduce the overall weight of cushion 10, and also allow cushion 10 to "self-adjust" to any irregularities, such as ridges or contours, in sloped surface 14 of seat 15 (see FIG. 2).

Cushion 10 is preferably manufactured from resilient molded polyethylene foam, although other molded foam constructions are also suitable. Also, cushion 10 should be finished with a thin, stain-resistant skin to allow for easy clean-up.

The method of using cushion 10 will now be explained with reference to FIGS. I and 2. The user first places cushion 10 on sloped surface 14 of seat 15, preferably orienting cushion 10 so that thicker rear edge 23 is toward the rear of seat 15, and so that thinner front edge 24 is toward the front of seat 15. When cushion 10 is placed in this manner, the top surface 20 is substantially level and horizontal, with angled lower cushion surface 21 offsetting or complementing the angle of sloped seat surface 14. Once cushion 10 is placed on seat 15, the parent can place an infant upon cushion 10 in any orientation. If cushion 10 is provided with one or more torso supports 22, the infant can be placed proximate or between those supports. After the parent changes the infant's diaper, cushion 10 can be cleaned if necessary, and can be stored for later use.

It should be understood that the above description is made only by way of example, and is not intended to limit the scope of the invention. Certain modifications may be made to the invention without departing from the spirit of the invention, which is defined by the appended claims.

I claim:

1. A method of changing an infant's diaper in a vehicle seat by providing an approximately horizontal diaper changing surface on the angled surface of a vehicle seat, the method comprising the steps of:

(a) providing a diaper changing pad having a top surface and a bottom surface being angled relative to the top surface;

(b) positioning the diaper changing pad on the angled surface of the vehicle seat;

(c) aligning the diaper changing pad relative to the vehicle seat so that the top surface becomes approximately horizontal;

(d) placing an infant upon the approximately horizontal top surface; and (e) changing the infant's diaper.

2. The method of claim 1, wherein the step of providing a diaper changing pad includes providing a diaper changing pad having a top surface angled relative to a bottom surface, the angle between the top surface and the bottom surface being approximately the same as the angle of the seat surface relative to the horizontal.

3. The method of claim 1, further comprising the step of placing the infant proximate at least one torso support attached to the diaper changing pad.

4. The method of claim 1, further comprising the step of placing the infant between at least two torso supports attached to the diaper changing pad.

5. The method of claim 1, wherein the step of providing a diaper changing pad includes providing a diaper changing pad having a front and rear edge, the thickness of the diaper changing pad at the front edge being less than the thickness of the diaper changing pad at the rear edge.

6. The method of claim 5, wherein the step aligning the diaper changing pad on the seat includes aligning the diaper changing pad so that the rear edge of the diaper changing pad aligns with the rear edge of the seat, and so that the front edge of the diaper changing pad aligns with the front edge of the seat, thereby providing an approximately horizontal surface.

* * * * *